US005600851A

United States Patent [19]

McLeod

[11] Patent Number: 5,600,851

[45] Date of Patent: Feb. 11, 1997

[54] NECKTIE CONSTRUCTION

[76] Inventor: James M. McLeod, P.O. Box 292, Valley Lee, Md. 20692

[21] Appl. No.: 436,114

[22] Filed: May 8, 1995

Related U.S. Application Data

[63] Continuation-in-part of Ser. No. 249,215, May 26, 1994.

[51] Int. Cl.[6] ..... A41D 25/02; A41D 25/04; A41D 25/08; A41D 25/10

[52] U.S. Cl. ..... 2/144; 2/145; 2/146; 2/148; 2/149; 2/150; 2/155; 2/156; 2/243.1

[58] Field of Search ..... 2/144, 145, 146, 2/147, 148, 149, 150, 151, 152.1, 153, 154, 155, 156, 243.1, 244; 156/305, 275.5, 275.7

[56] References Cited

U.S. PATENT DOCUMENTS

| | | | |
|---|---|---|---|
| 949,366 | 2/1910 | Reynolds | 2/14 |
| 1,349,187 | 8/1920 | Costello | 2/148 |
| 1,482,560 | 2/1924 | Hewes . | |
| 1,703,632 | 2/1929 | Moersch . | |
| 1,728,599 | 9/1929 | Fiumedoro . | |
| 1,737,322 | 11/1929 | Minton . | |
| 2,400,604 | 5/1946 | Scully | 2/148 X |
| 3,846,606 | 11/1974 | Edgar et al. | 219/10.55 |
| 4,671,992 | 6/1987 | Lancaster et al. | 428/316.6 |
| 4,777,665 | 10/1988 | Akamatsu . | |
| 4,856,115 | 8/1989 | Knapp . | |
| 5,165,112 | 11/1992 | Dawes | 2/149 X |
| 5,315,713 | 5/1994 | Pileggi | 2/145 |
| 5,400,460 | 3/1995 | Roeker et al. | 156/275.7 X |

OTHER PUBLICATIONS

Gershman, Maurice, "Self-Adhering Nylon Tapes", Journal of AMA, vol. 168, No. 7, p. 930, Oct. 1958.

*Primary Examiner*—Jeanette E. Chapman
*Attorney, Agent, or Firm*—Nixon & Vanderhye P.C.

[57] ABSTRACT

A pre-tied easily removable necktie includes an elongated strand of relatively soft, fabric having a relatively narrow end and a relatively wide end in overlapping relationship, tied to provide a permanent, adhesively fused knot therein and wherein a pair of tails extend away from the knot; and a relatively inelastic neck belt removably secured between the pair of tails, the neck belt having an elastic portion spliced between opposite ends thereof. A method of forming the pre-tied necktie includes the steps of:

a) tying the tie to include a full Windsor knot;

b) smoothing out any pleats or puckers in the fabric where the fabric exits the knot;

c) injecting a heat activatable adhesive into the knot, between layers of the fabric within the knot;

d) placing the tie in a microwave oven and subjecting the tie to microwave heating to thereby activate the adhesive; and e) curing the adhesive within the knot to form a relatively rigidified knot construction.

6 Claims, 4 Drawing Sheets

Fig. 2
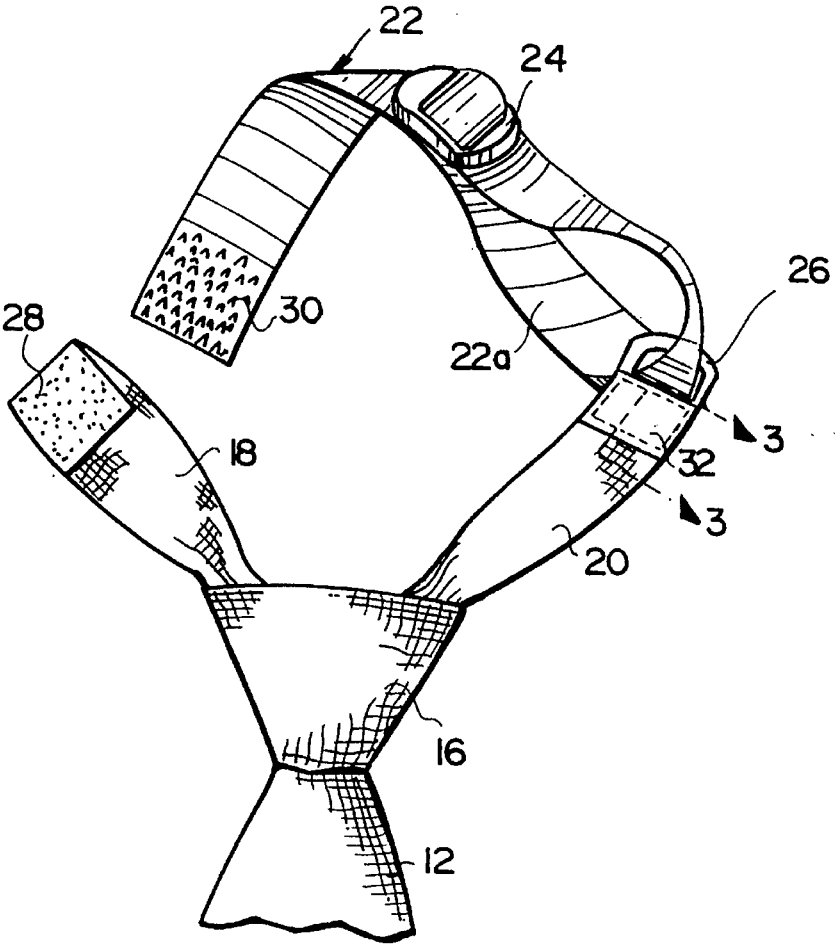
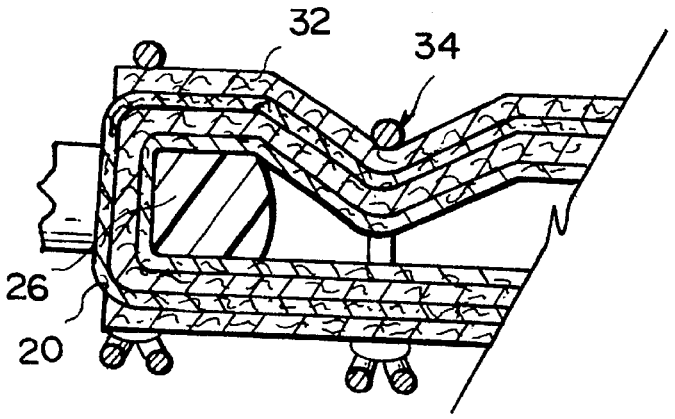
Fig. 3

Fig. 5
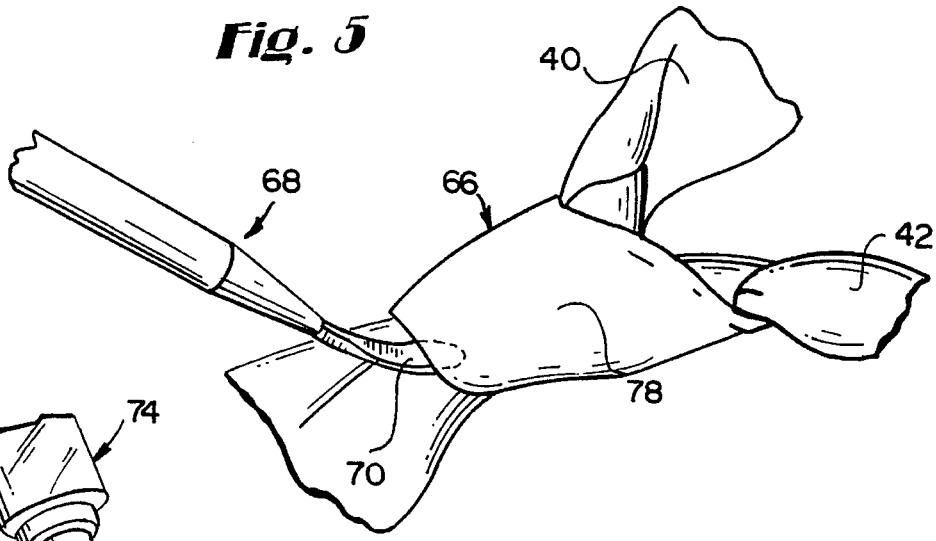
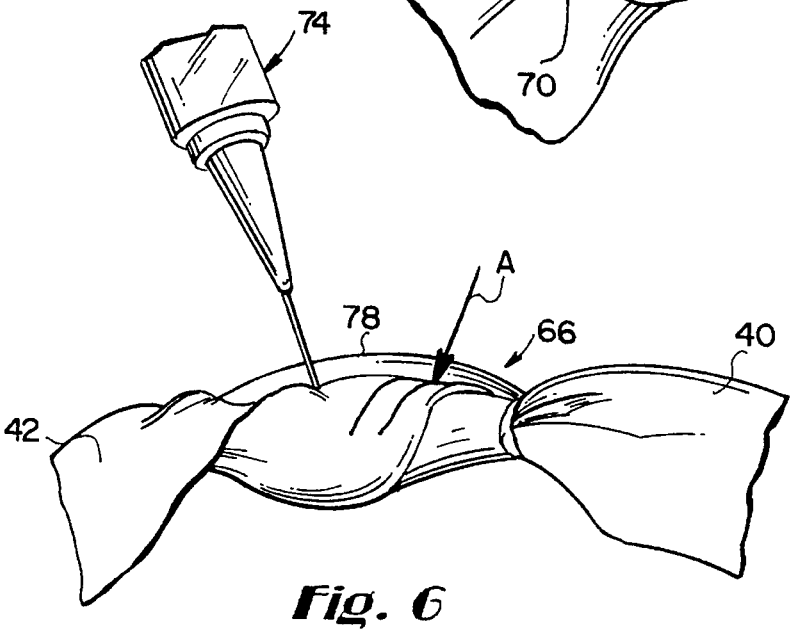
Fig. 6
Fig. 7
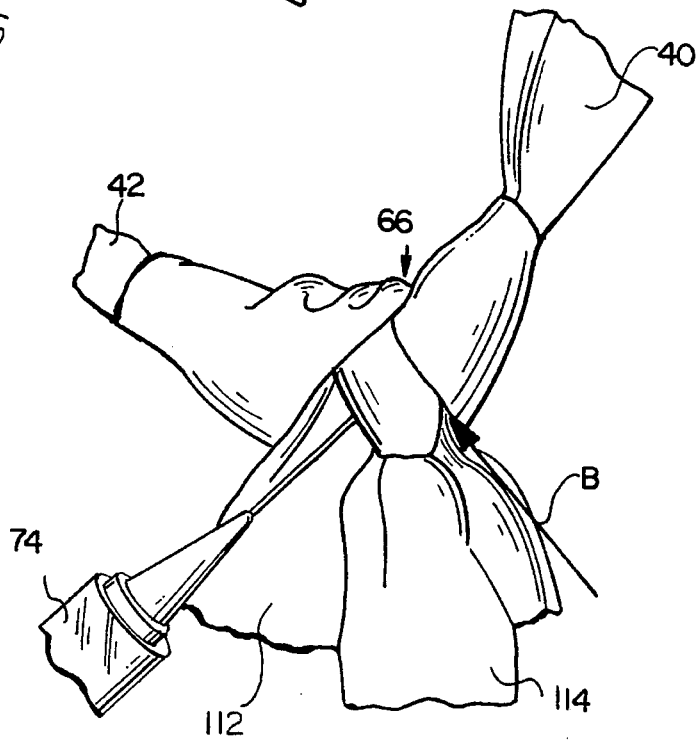

NECKTIE CONSTRUCTION

RELATED APPLICATIONS

This application is a continuation-in-part of my copending application Ser. No. 08/249,215 filed May 26, 1994.

The invention relates to a novel necktie construction which is pre-tied, and which includes a permanently formed knot, and an adjustable, easily connectable and disconnectable neck band.

BACKGROUND AND SUMMARY OF THE INVENTION

Pre-tied necktie constructions are well known in the art, and the concept has been applied to "bow" type as well as "four-in-hand" type ties. Four-in-hand type ties which incorporate "permanent" knots typically include a pair of metal clips to secure the tie to the shirt collar and are often referred to as "clip-on" ties. Pre-tied bow ties, on the other hand, often include a fabric band (usually of the same, non-elastic fabric as the tie itself) which is adapted to extend about the neck and to be secured to the back of the bow by means of a metal hook. The band is generally adjustable.

There remains a need for a pre-tied, four-in-hand type tie construction which can be put on and taken off easily, but which, when fastened about the neck, remains in place, is comfortable to wear, and is adjustable to the neck size of the wearer.

This invention addresses those needs by providing a four-in-hand type necktie which is pre-tied and which incorporates a permanent, adhesively fused knot, and an adjustable neck band which is adjustable and easily removable.

In a first exemplary embodiment, the necktie in accordance with this invention is constructed of an elongated strand of soft fabric (preferably lined silk, but other material may be used as well), having a relatively narrow end and a relatively wider end. The fabric is pre-tied to include a permanent knot (e.g., a full Windsor knot) so that the relatively wider end overlies the relatively narrower end in the usual fashion. In pre-tying the knot, a neck loop is formed in a manner similar to that which is formed by a wearer tying a tie after placing it around his shirt collar. Here, however, a relatively large portion of the neck band is removed, leaving a pair of relatively short neck engaging ends or tails extending away from the knot in substantially opposite directions.

An elastic, adjustable band is secured to the neck engaging ends or tails, in the manner of a "splice". In the first exemplary embodiment, the band is fixedly secured at a first end to one of the neck engaging tails of the tie, and releasably secured at a second end to the other of the neck engaging tails. In the preferred embodiment, a hook and loop type fastener (e.g., Velcro™) is used to releasably secure the band to the one neck engaging tail. More specifically, one element of the hook and loop fastener is fixed to the second end of the elastic band, and the other cooperating element of the hook and loop fastener is fixed to the other of the neck engaging tails. Thus, the releasable fastener is located relatively close to the knot and is easily accessible by the wearer. At the fixedly secured end of the band, a relatively strong plastic loop is used to secure the first end of the band to the one neck engaging tail. This loop is also used in conjunction with a conventional adjustment buckle which allows the band to be sized to the user. At both neck engaging tails, the connection to the elastic band is reinforced to insure that the band will disconnect only at the hook and loop fastener.

In accordance with a preferred embodiment of the pre-tied necktie, a removable "neck belt" is provided which affords the user the added benefits of a natural flexing action combined with a removability feature which allows the neck belt to be removed when, for example, the necktie is to be drycleaned. The neck belt includes a relatively inelastic strap which incorporates a conventional adjustment buckle similar to that in the first described embodiment, but which also includes a conventional snap loop which allows the belt to be removably attached to a complementary loop on one of the tails. The other end of the neck belt is provided with a hook and loop type fastener pad which is adapted to be secured to a complementary hook and loop fastener pad on the other of the tails. Adjacent the hook and loop fastener, there is a relatively short elastic band interposed between the fastener material and the relatively inelastic band which allows the neck belt to "breathe" with the user when the tie is in place.

It is a further feature of this preferred embodiment to include a curable adhesive within the knot itself to insure permanent shaping/fusing of the knot in accordance with a unique method described further below.

It is still another feature of the invention that during manufacture of the tie, a special tool is inserted into the top portion of the knot and rotated from left to right and right to left following the contour of the knot so that any existing pleats or puckers in the material are smoothed out. As a result, an essentially perfect full Windsor knot is provided.

Once the tie and knot are in final form, i.e., after the pleats or folds have been smoothed with the custom tool, a heat activatable adhesive is injected into the knot with a syringe device. Specifically, the syringe is inserted into the top front portion of the knot from above, and moved about to insure liberal application of the adhesive. The syringe is then removed from the top front portion of the knot and inserted into the bottom rear portion of the knot such, that the inside of the knot is substantially completely covered with adhesive. The tie is then placed on a rotating rack with other similarly constructed ties and placed into a microwave oven for a period of about 60 to 90 seconds, depending on the thickness of the material. Microwaving literally cooks the adhesive, and allows it to bond to the material so as to permanently maintain the Windsor knot shape. After the ties are removed from the microwave oven, they are hung on racks for up to 48 hours in an air filtered, ventilated area for curing. The narrow end of the tie is then hand sewn to the back of the front panel near its lower end so as to keep the two panels in substantially vertical alignment. The two ears or tails extending from the top of the knot are then finished off, one with the above mentioned hook and loop type fastener, and the other with a square essentially unbreakable closed plastic ring.

Thus, in accordance with the broader aspects of this continuation-in-part application, there is provided a pre-tied easily removable necktie comprising an elongated strand of relatively soft fabric having a relatively narrow end and a relatively wide end in overlapping relationship, tied to provide a permanent, adhesively fused knot therein and wherein a pair of tails extend away from the knot; and a relatively inelastic neck belt removably secured between the pair of tails, the neck belt having an elastic portion spliced between opposite ends thereof.

In another aspect, there is provided a method of forming a pre-tied necktie comprising the steps of:

a) tying the tie to include a full Windsor knot with a front panel and a rear panel;

b) smoothing out any pleats or puckers in the fabric where the fabric exits the knot;

c) injecting a heat activatable adhesive into the knot, between layers of the fabric within the knot;

d) placing the tie in a microwave oven and subjecting the tie to microwave heating to thereby activate the adhesive; and e) curing the adhesive within the knot to form a relatively rigidified knot construction.

The necktie construction as described above has several advantages:

1) The tie is easily put on and taken off and, in fact, this can be done with one hand, an especially useful feature for persons with physical disabilities;

2) The tie is easily adjustable to the neck size of the wearer;

3) The easy release feature has safety advantages in that the tie will detach and pull away from the wearer's neck with relatively little force;

4) The removable neck belt allows the user to have the tie drycleaned without the neck belt attached;

5) The neck belt also insures both secure attachment and comfort; and

6) The elastic insert within the neck belt allows the latter to breathe naturally with the user when in place.

Other objects and advantages will become apparent from the detailed description which follows.

BRIEF DESCRIPTION OF THE DRAWINGS

FIG. 2 is a partial perspective of the necktie illustrated in FIG. 1, but with the elastic neck band shown in a disconnected or opened condition;

FIG. 3 is a section taken along the line 3—3 of FIG. 2;

FIG. 5 is a partial perspective view of the necktie in accordance with the preferred embodiment, with a special tool in place to smooth out the pleats within the fabric;

FIG. 6 is a partial top perspective of the preferred necktie in accordance with this invention, illustrating the application of adhesive in the top forward or front area of the necktie; and FIG. 7 is a partial rear perspective illustrating the manner of application of adhesive from the lower rear portion of the preferred necktie in accordance with the invention.

DETAILED DESCRIPTION OF THE DRAWINGS

Figure 1:
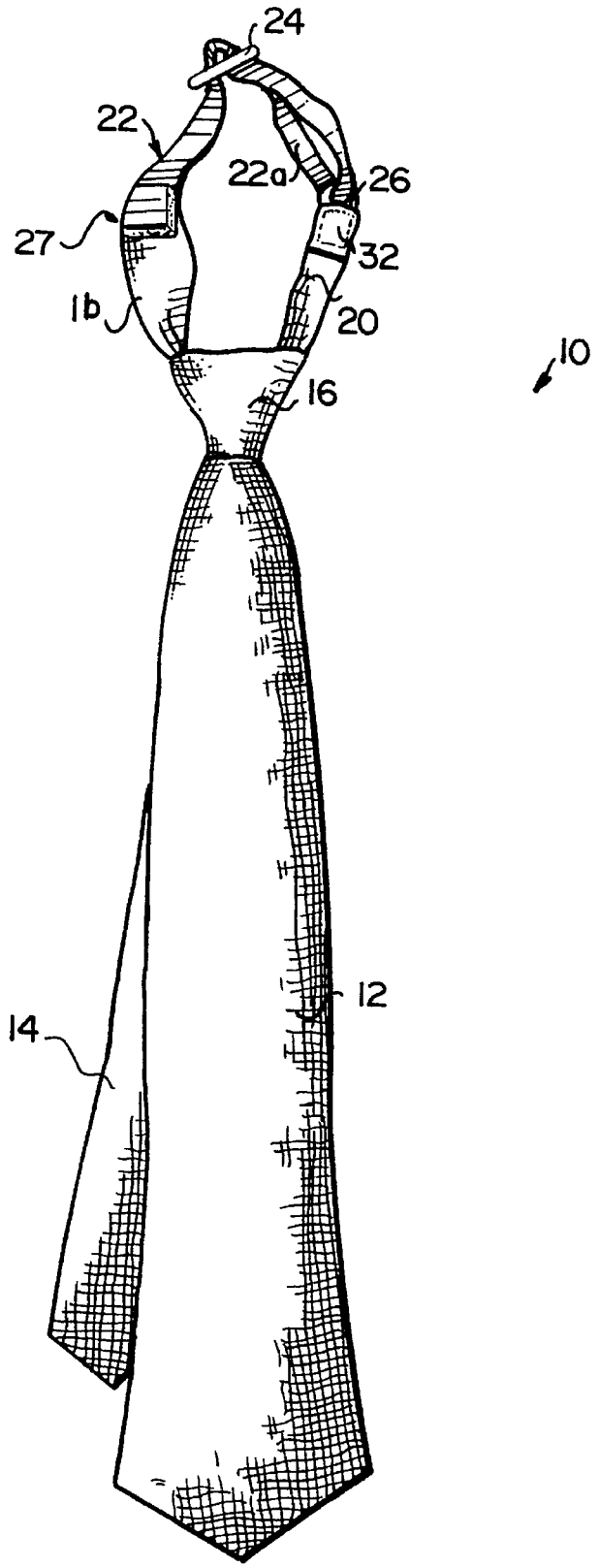
FIG. 1 is a perspective view of a necktie construction in accordance with this invention.

With reference now to FIGS. 1 and 2, the necktie construction 10 in accordance with a first exemplary embodiment of this invention is formed and tied in the conventional fashion to include an outer wider section of the tie 12 and an inner narrower section of the tie 14. A conventional knot 16, such as a full Windsor knot as illustrated, is permanently formed in the tie construction and the usual neck band area of the tie is cut to provide shortened, neck engaging tails or ends 18 and 20 extending in either direction away from the knot 16. It should be noted here that other methods to form the knot 16 and neck engaging ends 18 and 20 (such that it may not be necessary to form a closed neck loop and then sever a portion of that loop), may be used without departing from the spirit and scope of this invention.

The tie construction as described above is combined with a conventional elastic, adjustable band 22 which includes an adjustment buckle 24 which allows the user to shorten or lengthen the band by utilizing more or less of the overlapped portion 22*a* of the band. In addition, the band 22 includes a sturdy plastic loop 26 which is utilized to secure the band 22 to the tail 20 by overlapping a portion of the tail 20 through the loop and sewing the latter to the remaining portion of the tail. At the other end of the elastic band, a hook and loop type fastener 27 (preferably Velcro™) is employed at overlapping "pads" 28 and 30. In other words, and as best seen in FIG. 2, one part (e.g., 28) of the hook and loop type fastener is secured (by sewing for example) to the free end of the tail 18, thus also reinforcing the tail 18, and the other part (e.g., 30) of the hook and loop type fastener 27 is similarly secured to the free end of the band 22. In this way, the tie can be easily located about the neck of the user and secured by the fastener 27. The user may then adjust the length of the elastic band 22 via buckle 24 to provide the desired degree of snugness about the neck.

Turning to FIG. 3, it will be appreciated that the manner of attachment of the loop 26 to the tail 20 provides a strong reinforcement which insures that the band 22 will not disconnect from the tie at this end. More specifically, in addition to the fabric of tail 20 being drawn through the loop and doubled back on itself, an additional strip of material 32 is wrapped about the end of the tail 20 in the area of the double fold, and stitched about its periphery and at 34 to form a sturdy connection.

It will be apparent that the tie construction in accordance with this invention has specific advantages over conventional pre-tied constructions. For example, a handicapped person is able to fasten the tie 10 about a shirt collar with the use of only one hand, simply by tucking the knot 16 under the chin, moving the band 22 about the neck, and securing the fastener portion 28 to the cooperating fastener portion 30. The tie construction in accordance with this invention also facilitates easy removal of the tie by simply separating the fastener portions 28 and 30. An alternative and even quicker manner of removal of the tie involves a sharp pulling of the tie in a downward direction causing the fastener portions 28 and 30 to disconnect and the tie to come away from the neck. This latter feature has safety related aspects as well. For example, persons who work in machine environments have a legitimate concern about ties being caught in rotating or other machinery which can draw the person's head toward the machine with potentially catastrophic results. With the tie in accordance with this invention, the tie will be quickly disconnected from the neck of the user in light of the relatively low force required to separate the fastener portions 28 and 30. Obvious concerns of law enforcement personnel regarding potential harm to themselves via their own neckties are also alleviated by this invention. In the above scenarios, the reinforced tails 18 and 20 insure that separation will occur only at the cooperating fastener elements 28 and 30, so that the tie itself will not be damaged by sudden disconnection.

With reference now to FIGS. 4–7, a preferred necktie construction is illustrated which provides additional benefits and advantages over and above those associated with the first described embodiment. This preferred embodiment includes a removable neck belt 36 in combination with the necktie construction 38. The necktie 38 includes a front panel 112 and a rear panel 114, along with a pair of tails or ends 40, 42 which are similar to the tails 18, 20, as illustrated in FIGS. 1 and 2. Thus, the tail 40 is provided with a pad of hook and loop type fastener material 44 (preferably Velcro™), while the tail 42 is provided with a sturdy plastic loop 46 secured by overlapping a portion of the tail 42. The overlapped portion is sewn and reinforced with an additional strip of fabric as shown at 48.

The neck belt 36 is formed with a relatively inelastic strip or band 50 which may be comprised of material such as vinyl, leather and/or woven nylon (or other suitable material, and which may be provided in various colors). The band 50 is provided with a conventional adjustment buckle 52 which allows the band (which is overlapped through a closed loop 54) to be adjusted in conventional fashion. The loop 54 also secures a snap fastener band 56 which includes complementary snap fastener portions 58 and 60. The snap fastener band 56, which may be of the same material as the band 50, is adapted to be threaded through the loop 46 secured to tail 42, with snap fastener 58 then engaged with complementary fastener 60.

The other end of the band 50 is provided with a relatively short elastic band portion 62 (sewn to the relatively inelastic band 50 and reinforced as shown at 64). This elastic band portion 62 terminates at a hook and loop type fastener pad 64 which is adapted to engage the hook and loop type fastener on the tail end 40.

With the above described arrangement, not only is the neck belt 36 removable so as to permit easy drycleaning of the necktie itself, but the unique combination of fasteners and elastic and inelastic material allows the neck belt to securely attach the necktie about the neck of the user while at the same time, permitting the neck belt to breathe with the user by means of the elastic band portion 62.

Figure 4:
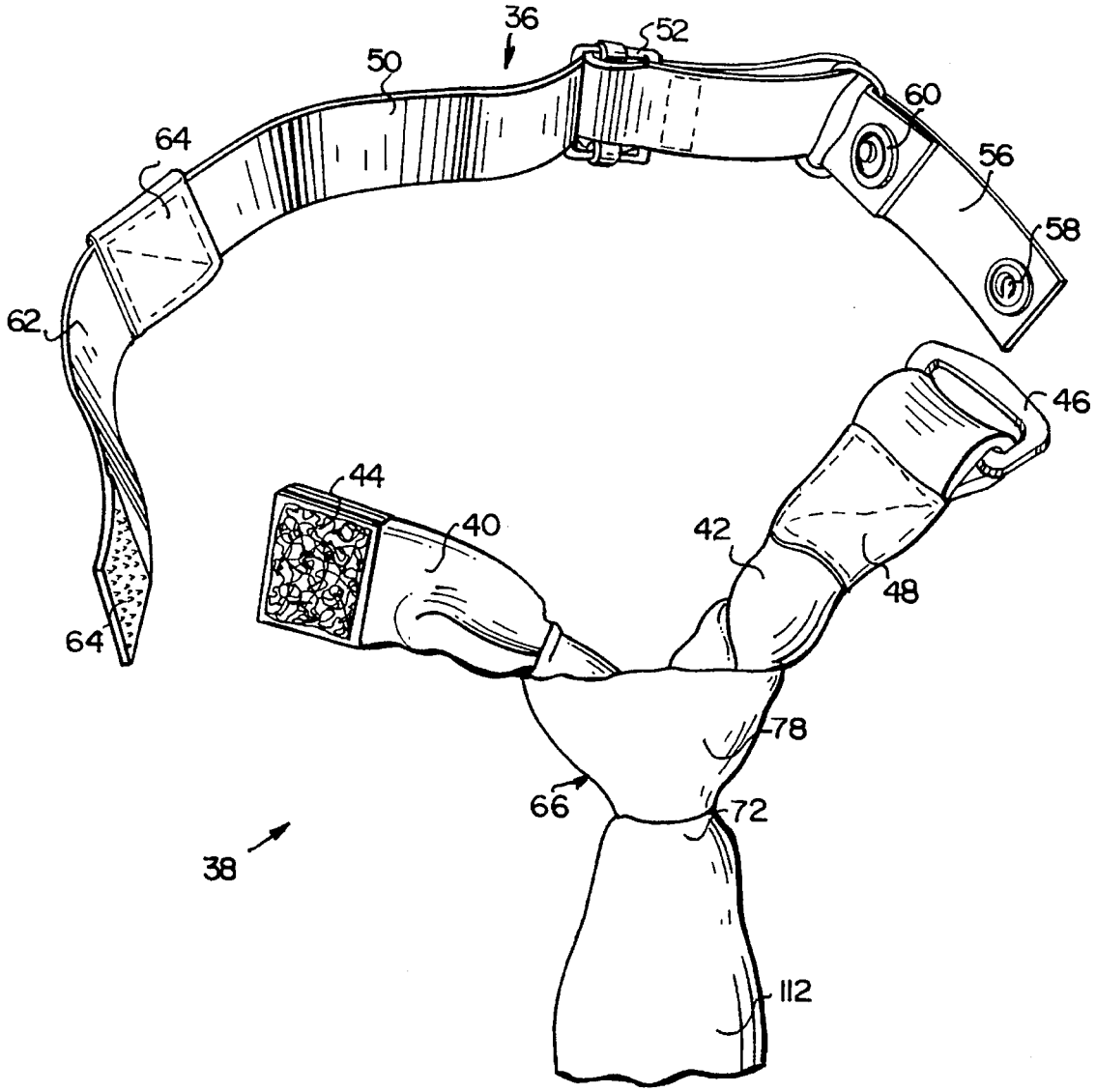
FIG. 4 is an exploded perspective view of a necktie construction in accordance with a preferred embodiment of the invention.

Turning now to FIGS. 5–7, I will now explain the unique manner in which the necktie of this invention is constructed. After tying the full Windsor knot, illustrated generally at 66 in FIG. 5, a specialized tool 68 having an elongated, curved and rounded tool projection 70 extending from one thereof, is utilized to smooth out the tie fabric at 72 which would otherwise include pleats or puckers. By utilizing the specialized tool 68, all pleats and/or puckers can be removed so that the fabric extends from the knot as shown in FIG. 4 in an essentially perfectly smooth fashion.

After the knot is formed as described above, a garment adhesive in paste form (which may comprise a mixture of two parts liquid Fab-Tac to one part powdered Liquid Fuse, both available from Beacon Chemical Corp.) is injected into the knot utilizing a syringe 74 having an orifice diameter of, for example, 1/32 of an inch. The adhesive mixture identified above is particularly advantageous in that the powdered component absorbs any water in the liquid component so that no water marks appear on the tie fabric. Other adhesive compositions may also be suitable, however.

The syringe 74 is first inserted from above into the forward portion of the knot 66, just behind the outwardly facing fabric of the knot panel 78 and, moving the syringe around and about the rearwardly facing side of the panel 78 (and/or by reinserting the syringe in the area identified by arrow A), a liberal amount of adhesive is injected into the knot. Then, the syringe 74 is removed and reinserted from behind and below the knot 66 as best seen in FIG. 7. Here again, the syringe 74 is moved about (and/or reinserted at the area identified by arrow B) as liquid adhesive is injected into the knot. In this way, the forward facing panel 78 is permanently adhered from both above and below to the underlying tie fabric.

The necktie 38 is then placed on a rotating rack with other similarly constructed ties, and placed into a microwave oven which is set for about 60 to 90 seconds, depending on the thickness of the tie material and the specific kind of adhesive employed. Microwave heat literally cooks the adhesive so that it flows about within the knot and becomes permanently bonded to the fabric. After the tie 38 (and other similar ties) are removed from the oven, they are hung on racks for up to 48 hours so that the adhesive can fully cure. Curing is preferably carried out in an air filtered, well ventilated area. The adhesive when cured essentially provides a rigid form, similar to the manner in which fiberglass resin and fiberglass fabric interact.

Once the adhesive process is completed, the lower portion of the rear panel 114 is sewn to the back of the front panel 112 (preferably at the label), so that the front panel and rear panel are maintained in substantially vertical alignment. Thereafter, the tail ends 40 and 42 are finished off to include the hook and loop fastener material 44 and the plastic loop 46. The neck belt 36 can then be secured at the ends of the respective tail portions 40 and 42. In this preferred embodiment, the neck belt is preferably a cross woven material such as 70 denier nylon, covered with vinyl or leather. It will be appreciated that neck belts of various sizes may be provided, in order to accommodate neck sizes from 15 to 24.

There are many other examples where the tie in accordance with this invention will have clear advantages over conventional tie constructions. For example, in restaurants or other establishments where ties are required, consumers who wish to enter such establishment without a tie can be given an attractive tie which is easy to put on without embarrassing delays and without the use of a mirror.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of forming a pre-tied necktie comprising the steps of:

a) tying the tie to include a knot and a closed neck band;

b) removing a portion of the neck band to form a pair of shortened tails extending away from the knot;

c) injecting a heat activatable adhesive into the knot, between layers of the fabric within said knot;

d) placing the tie in a microwave oven and subjecting the tie to microwave heating to thereby activate said adhesive;

e) curing said adhesive within said knot to form a relatively rigidified knot construction.

2. The method of claim 1 and including the additional step of interposing a detachable neck belt between said pair of tails, and wherein said neck belt includes a fastening means at opposite ends thereof for securing said neck belt to said pair of tails.

3. The method of claim 1 and including, prior to step (c), the step of smoothing out any pleats or puckers in the fabric where the fabric exits the knot.

4. The method of claim 1 wherein step (d) is carried out for about 60–90 seconds.

5. The method of claim 1 wherein step (e) is carried out for about 48 hours.

6. A method of forming a pre-tied necktie comprising the steps of:

a) tying the tie to include a knot;

b) injecting a heat activatable adhesive into the knot, between layers of the fabric within said knot;

c) placing the tie in a microwave oven and subjecting the tie to microwave heating to thereby activate said adhesive; and d) curing said adhesive within said knot to form a relatively rigidified knot construction.

* * * * *